US005203543A

United States Patent [19]

Fleury

[11] Patent Number: 5,203,543

[45] Date of Patent: Apr. 20, 1993

[54] GUARDRAIL SUPPORT BRACKET

[75] Inventor: Henri-Paul Fleury, Drummond, Canada

[73] Assignee: Les Entreprises Gifab Ltee, Drummond, Canada

[21] Appl. No.: 879,306

[22] Filed: May 7, 1992

[30] Foreign Application Priority Data

May 3, 1991 [CA] Canada ..... 2043584

[51] Int. Cl.[5] ..... A01K 3/00

[52] U.S. Cl. ..... 256/13.1; 256/19; 256/65; 248/66

[58] Field of Search ..... 256/13.1, 65, 19; 248/66; 403/389, 390

[56] References Cited

U.S. PATENT DOCUMENTS

| | | | |
|---|---|---|---|
| 2,608,386 | 8/1952 | Hart | 256/65 |
| 3,258,250 | 6/1966 | McMullin . | |
| 3,360,244 | 12/1967 | Bucher . | |
| 3,519,249 | 7/1970 | Nave . | |
| 3,524,627 | 8/1970 | Boyanton et al. | 256/65 |
| 4,838,523 | 6/1989 | Humble et al. | 256/13.1 |
| 4,899,991 | 2/1990 | Brunkan | 256/65 X |

*Primary Examiner*—Andrew V. Kundrat
*Attorney, Agent, or Firm*—Jones, Tullar & Cooper

[57] ABSTRACT

A bracket for mounting a roadway guardrail to a post adjacent a roadway involves a generally rectangular backing member having an inwardly-extending flange extending along each of the upper and lower edges thereof. The bracket can be interposed between, preferably, a W-shaped guardrail and the post with the upper and lower edges of the guardrail being located adjacent the upper and lower flanges of the bracket respectively. The normal guardrail-mounting bolt will extend through the guardrail, a central aperture in the bracket, and the mounting post for clamping the guardrail end bracket to the post. Upon the impact, particularly sliding impact from a snowplow or the like, the upper and lower edges of the guardrail will contact the flanges and further deformation thereof will be resisted by the flanges. Thus the guardrail which would otherwise be detrimentally deformed by minor impacts will now retain its shock-absorbing capabilities, such detrimental having been resisted by the back of the invention.

10 Claims, 2 Drawing Sheets

FIG. 5
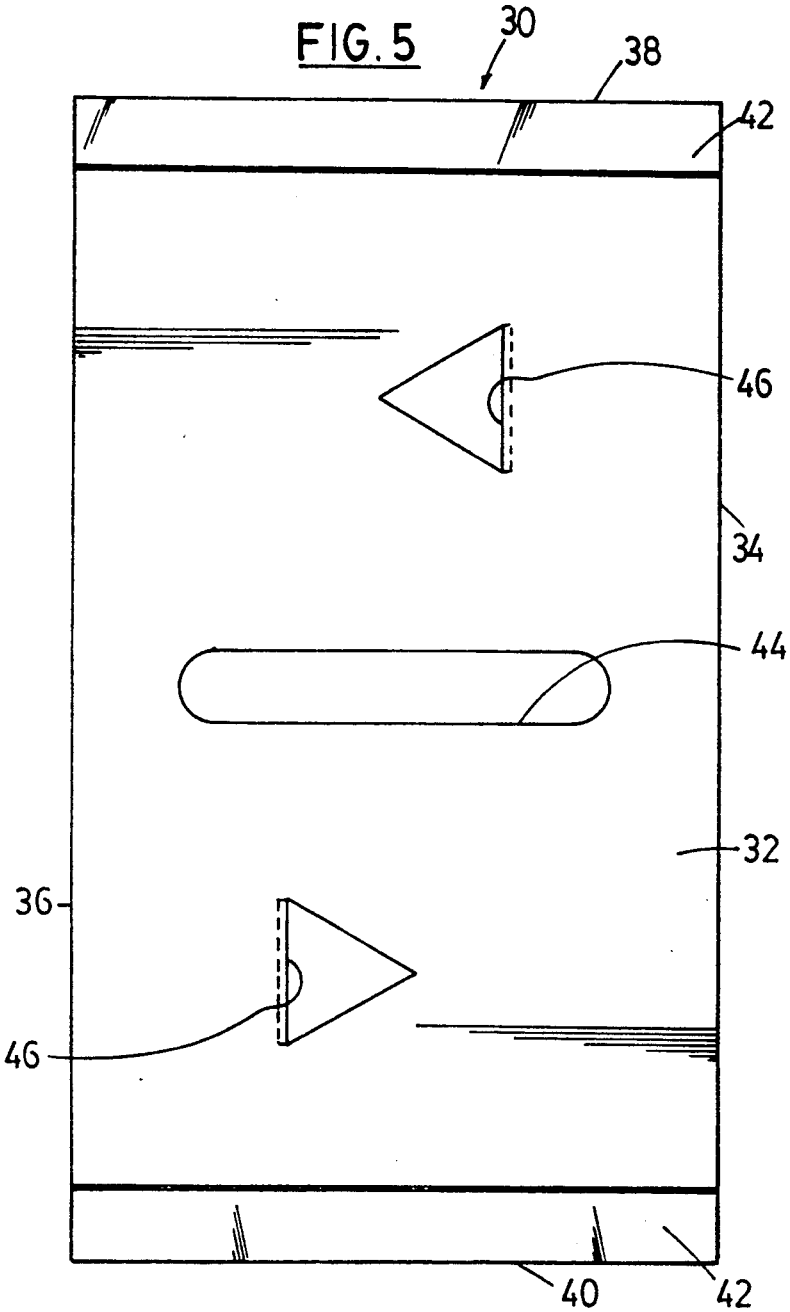
FIG. 6
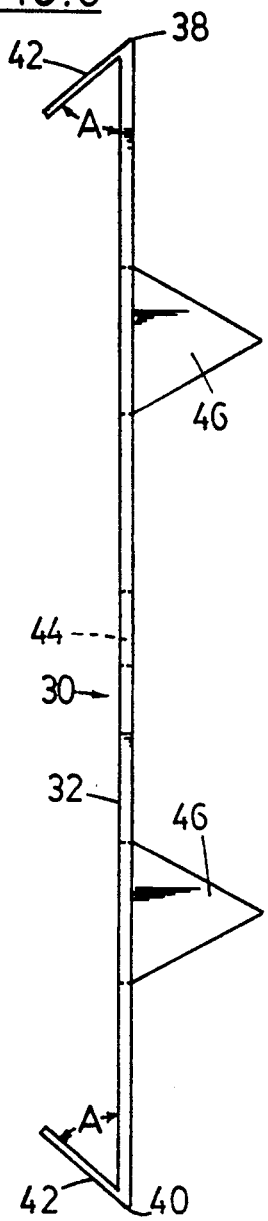
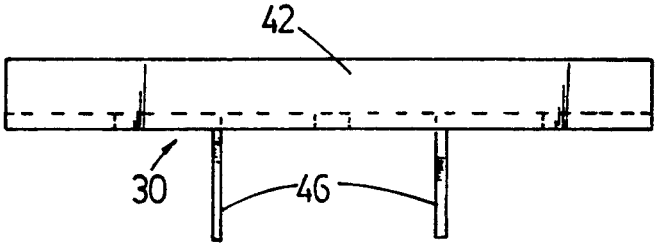
FIG. 7

GUARDRAIL SUPPORT BRACKET

This invention relates in general to roadway guardrails and in particular to a new bracket useful in mounting a guardrail to a post adjacent a roadway.

BACKGROUND OF THE INVENTION

Most roadways or highways are provided with guardrails adjacent the roadway, particularly in dangerous areas, the guardrails serving to prevent a vehicle from leaving the right of way in the event of an accident or a loss of control. Many lives have been saved by such guardrails.

Guardrails are usually made up of longitudinally extending sections of rail mounted to generally vertical posts spaced apart adjacent the roadway. The posts are usually spaced from the edge of the road surface, usually adjacent an intervening shoulder. There may be a mounting block between the rail and the post to lesson the possibility of impact between a vehicle and a post itself. Two common cross-sections for guardrails include a hollow square or rectangular box section and a "W"-shaped section. The latter is actually closer to a pair of vertically-spaced sideways-lying shallow "V"-shaped channel section joined by a narrow central straight portion extending between the ends of adjacent legs of the channel sections. When there is contact between a vehicle and the guardrail, particularly in the vicinity of a post, each of the channel sections will act as a shock absorber as it flattens under the effects of the impact. This reduces the possibility of post breakage and helps to keep the vehicle within the roadway right of way.

In wintertime conditions large graders and trucks carrying plows are used to keep the roadway clear of snow. These plows also keep the shoulders clear and, very often, there is forceful sliding contact between the end of a snowplow blade and the guardrail. Such contact can be sufficiently great so as to deform the guardrail, much as can happen in a vehicular impact. If a deformed guardrail is later struck by a vehicle it will not be able to perform its shock absorbing function and hence there is an increased chance of vehicular damage and/or post breakage. Damaged guardrails must be replaced, at considerable expense to the provincial or state government, and hence it is very desirable to minimize the damage suffered by guardrails in non-vehicular accident incidents.

SUMMARY OF THE INVENTION

The present invention reduces the problems occasioned by impact damage to roadway guardrails by providing a bracket interposable between the guardrail and its mounting post. The bracket, typically made of steel, has upper and lower edge flanges which extend forwardly of the bracket. When the guardrail and the bracket are mounted to a post the upper and lower edges of the guardrail are located adjacent, or against, the upper and lower flanges respectively of the bracket. Should there be an impact or sliding force against the guardrail of the type effected by a snowplow there will be a tendency for the guardrail to deform, which tendency is resisted by the flanges of the bracket. There could possibly be some permanent deformation to the guardrail but such deformation will be much less than if the bracket of this invention were not used. The guardrail will still be able to perform its impact-resisting function in the event of a vehicular impact even though there might be some deformation due to contact by a snowplow or other such sliding contact.

As indicated above the flanges of the inventive bracket will resist deformation of the guardrail when it is subject to low impact or to sliding impact, impacts which would otherwise detrimentally deform the guardrail. When a guardrail mounted with the bracket of this invention is subjected to a sharp impact, as in a vehicular accident, it will still perform its shock-absorbing function since the resistance provided by the edge flanges is not so great as to prevent desired deformation of the guardrail. Under sharp impact the flanges will bend under the forces imparted thereto by the deforming walls of the guardrail, allowing such walls to continue to deform in the desired manner.

Broadly speaking, therefore, the present invention may be considered as providing a bracket for mounting a roadway guardrail to a post adjacent a roadway comprising: a generally rectangular backing member having opposed upper and lower edges and opposed side edges; inwardly extending end flanges, one such flange extending along each of the upper and lower edges, each flange being adapted for retaining abutment against a corresponding longitudinal edge of a guardrail; and elongated aperture means therethrough adapted for cooperation with bolt-receiving aperture means in the guardrail normally used for mounting the guardrail to a post.

The invention also contemplates a system for mounting a generally W-shaped roadway guardrail to a generally vertically oriented post adjacent a roadway comprising: a bracket for interposing between the guardrail and the post, the bracket having a generally rectangular backing member with opposed upper and lower edges and opposed side edges, inwardly extending upper and lower flanges extending transversely of the backing member along the upper and lower edges respectively and adapted for retaining abutment with respective upper and lower longitudinal edges of a guardrail, an elongated central aperture means; and bolt means for extending through a central aperture in the guardrail, the aperture means in the bracket, and a corresponding bore in the post for mounting the guardrail and the bracket to the post.

BRIEF DESCRIPTION OF THE DRAWINGS

FIG. 5 shows a front view of the bracket of this invention.

FIG. 6 shows a side view of the bracket of this invention.

FIG. 7 shows an end view of the bracket of this invention.

DESCRIPTION OF THE PREFERRED EMBODIMENT

Figure 1:
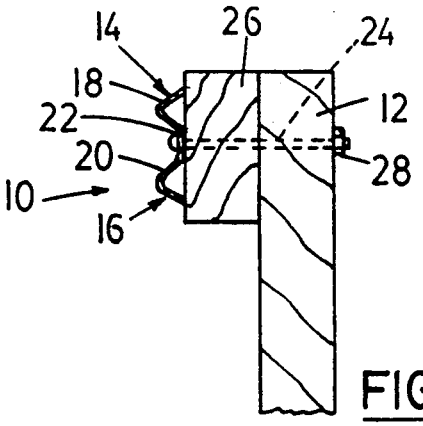
FIG. 1 PRIOR ART
FIG. 1 shows a side view of a typical prior art guardrail mounted to a post adjacent a roadway.

FIG. 1 shows an end or sectional view of a typical W-shaped guardrail 10 mounted to a wooden post 12 adjacent a roadway. The guardrail has longitudinally extending upper and lower generally V-shaped channel portions 14,16 respectively, the adjacent walls 18,20 thereof being joined by a central web 22. One or more bolts 24 secure the guardrail 10 to the post 12, often through a mounting block 26 which spaces the guardrail forwardly of the post 12. A nut 28 is attached to each bolt 24 to complete the mounting system.

Figure 2:
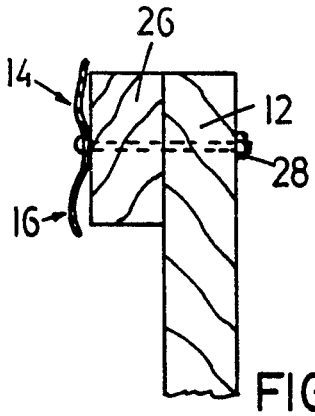
FIG. 2 PRIOR ART
FIG. 2 shows the guardrail of FIG. 1 after impact.

FIG. 2 shows that after low or sliding impact the upper and lower channel portions 14,16 have deformed from the configuration shown in FIG. 1. Since the portions 14,16 have flattened somewhat they are no longer capable of fully absorbing the impact forces to which they might be subjected in a serious vehicular accident. There would be a greater expectation of post breakage and damage to both the vehicle and the guardrail.

The remaining figures illustrate the bracket of the present invention, both by itself and as assembled with a guardrail.

With particular reference to FIGS. 5, 6 and 7 the bracket 30 of the present invention is seen as including a generally rectangular backing member 32 having opposite side edges 34,36 and opposite upper and lower end edges 38,40. Along each of the end edges there is a short, transverse flange 42 extending inwardly of the backing member. Preferably the flanges 42,42 are also angled inwardly towards each other so as to define an acute angle "A" with the adjacent backing member surface.

A central transverse slot 44 extends through the body portion intermediate the ends 38,40. Optional pointed, generally triangular, tabs 46,46 can be punched from the backing member, being bent along one side thereof so as to extend normal to the rear surface of the backing member 32. Preferably the bracket 30 is formed from a piece of steel about 3.2 mm thick, the flanges 42,42 being bent therefrom to a height of about 25.4 mm. The tabs 46 also extend about 25.4 mm from the backing member 32. The overall dimensions of the backing member 32 will of course depend on the dimensions of the guardrail with which it will be used.

Figure 3:
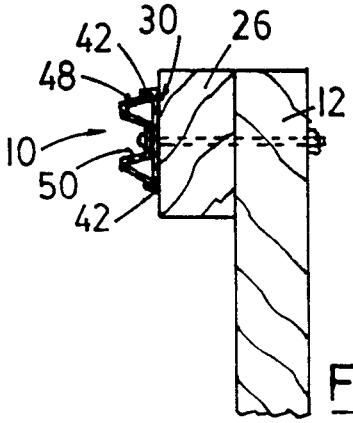
FIG. 3 shows the guardrail of FIG. 1 with the bracket of this invention mounted therewith.
Figure 4:
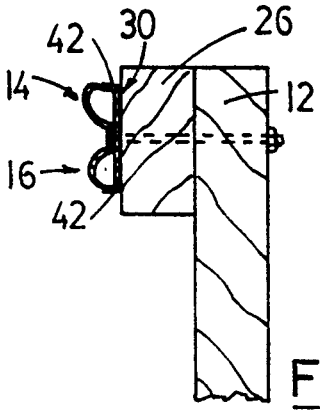
FIG. 4 shows the guardrail system of FIG. 3 after low or sliding impact.
Figure 8:
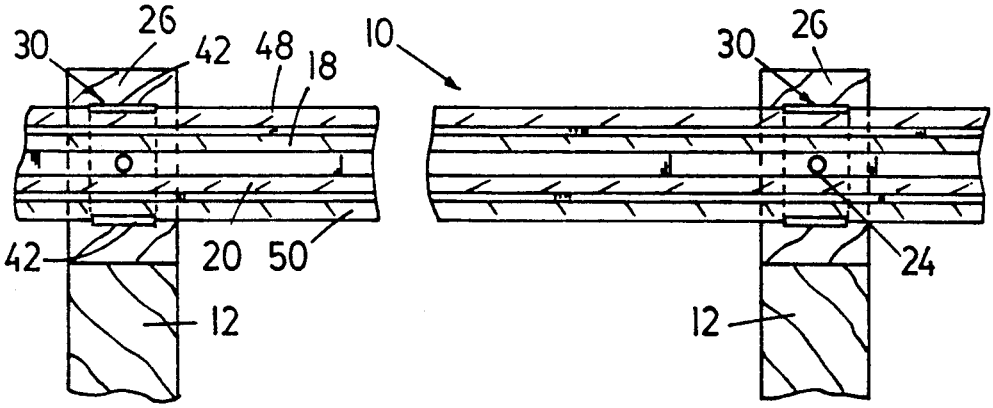
FIG. 8 shows a front view of a guardrail system according to this invention.

FIGS. 3, 4, and 8 show the bracket 30 in use. In FIGS. 3 and 8 it will be seen that the bracket 30 is interposed between the guardrail 10 and the mounting block 26 such that the mounting bolt 24 will pass through the slot 44 to clamp the bracket against the mounting block 26 when tightened. The longitudinally extending edges of the upper and lower legs 48,50 of the guardrail will be close to the flanges 42,42 and in fact may abut thereagainst or extend into the corner defined between the flange and the backing member. If tabs 46 have been provided they will but into the wooden mounting block to anchor the bracket and to help prevent it from rotating upon impact.

FIG. 4 illustrates generally the effect of the bracket 30 on a guardrail that has been subjected to sliding impact, as from a snowplow or a skidding vehicle. In comparison to FIG. 4 it will be seen that the upper and lower channel sections 14,16 have been able to retain a close approximation to their original shape due to the fact that the flanges 42,42 have prevented the uppermost and lowermost legs 48,50 of the guardrail from moving upwardly and downwardly respectively. The flanges 42,42 may deform somewhat and the channel portions 14,16 may become more curved than V-shaped but they will still retain a good portion of their impact absorbing capabilities, much more than if the bracket 30 had not been used.

If the bracket 30 has been anchored to the mounting block 26 (or to the post 12 if no mounting block has been used) then the bracket will also resist the tendency of the guardrail to rotate on the mounting block, or post, upon impact.

In summary, therefore, the bracket of the present invention prolongs the life of most guardrails by limiting the deformation that occurs from sliding impact such as might be imposed by a snowplow so that the guardrail can retain the majority of its impact-absorbing capability following such minor impact. Since deformed guardrails must be placed as quickly as possible the utilization of the present invention, which is very inexpensive to produce and install, results in a considerable saving to the highway authority.

A preferred embodiment of the present invention has been disclosed herein but it is clear that changes or modification may occur to a skilled individual in the art without departing from the spirit of this invention. Thus the protection to be afforded is to be determined from the scope of the claims appended hereto.

I claim:

1. A bracket for mounting a roadway guardrail to a wooden post adjacent a roadway comprising: a generally rectangular backing member having opposed upper and lower edges and opposed side edges; inwardly extending end flanges, one such flange extending along each of said upper and lower edges, each flange being adapted for retaining abutment against a corresponding longitudinal edge of a guardrail; elongated aperture means therethrough adapted for cooperation with bolt-receiving aperture means in the guardrail normally used for mounting the guardrail to a post; and at least one pointed tab extending rearwardly of the backing member for anchoring the bracket to a wooden post.

2. The bracket of claim 1 wherein the pointed tab is triangular and is formed from the material of the backing member.

3. A system for mounting a generally W-shaped roadway guardrail to a generally vertically oriented post adjacent a roadway comprising: a bracket for interposing between the guardrail and the post, the bracket having a generally rectangular backing member with opposed upper and lower edges and opposed side edges, inwardly extending upper and lower flanges extending transversely of the backing member along the upper and lower edges respectively and adapted for retaining abutment with respective upper and lower longitudinal edges of a guardrail, and elongated central aperture means; and bolt means for extending through a central aperture in the guardrail, the aperture means in said bracket, and a corresponding bore in the post for mounting the guardrail and said bracket to the post.

4. The system of claim 3 wherein said bracket includes at least one pointed tab extending rearwardly of the backing member for retaining engagement with a wooden post.

5. The system of claim 4 wherein the tab is triangular and is formed from the material of the backing member.

6. The system of claim 3 including a wooden mounting block positioned between the bracket and the post.

7. A bracket for mounting a roadway guardrail to a post adjacent a roadway comprising: a generally rectangular backing member having opposed upper and lower edges and opposed side edges; an end flange extending along each of said upper and lower edges, each such flange extending inwardly at an acute angle with the adjacent surface of the backing member for retaining abutment against a corresponding longitudinal edge of a guardrail; and elongated aperture means therethrough adapted for cooperation with bolt-receiving aperture means in the guardrail normally used for mounting the guardrail to a post.

8. The bracket of claim 8, further including means for anchoring the bracket to a post.

9. The bracket of claim 8, wherein the anchoring means comprises at least one pointed tab extending rearwardly of the backing member.

10. The bracket of claim 9, wherein the pointed tab is triangular and is formed from the material of the backing member.

* * * * *

UNITED STATES PATENT AND TRADEMARK OFFICE

CERTIFICATE OF CORRECTION

PATENT NO. : 5,203,543
DATED : April 20, 1993
INVENTOR(S) : Fleury, Henri-Paul

It is certified that error appears in the above-indentified patent and that said Letters Patent is hereby corrected as shown below:

Claim 8, line 1 of the claim, cancel "8" and insert --7--.

Signed and Sealed this

Twenty-fifth Day of January, 1994

*Attest:*

Bruce Lehman

BRUCE LEHMAN

*Attesting Officer*

*Commissioner of Patents and Trademarks*